US009873961B2

(12) United States Patent
Cittadini et al.

(10) Patent No.: US 9,873,961 B2
(45) Date of Patent: Jan. 23, 2018

(54) SHEDDING MECHANISM COMPRISING A LEVEL ADJUSTMENT DEVICE AND WEAVING MACHINE INCLUDING SAID MECHANISM

(71) Applicant: STAUBLI FAVERGES, Faverges (FR)

(72) Inventors: Joseph Cittadini, Monthion (FR); David Bonneau, Lathuile (FR)

(73) Assignee: STAUBLI FAVERGES, Faverges (FR)

( * ) Notice: Subject to any disclaimer, the term of this patent is extended or adjusted under 35 U.S.C. 154(b) by 0 days.

(21) Appl. No.: 15/334,534

(22) Filed: Oct. 26, 2016

(65) Prior Publication Data

US 2017/0121865 A1 May 4, 2017

(30) Foreign Application Priority Data

Oct. 29, 2015 (FR) ..... 15 60370

(51) Int. Cl.
*D03C 5/02* (2006.01)
*D03C 5/00* (2006.01)

(52) U.S. Cl.
CPC ..... *D03C 5/005* (2013.01); *D03C 5/02* (2013.01)

(58) Field of Classification Search
CPC ..... D03D 51/46; D03D 51/40; D03D 51/18
See application file for complete search history.

(56) References Cited

U.S. PATENT DOCUMENTS 3,856,055 A * 12/1974 Hirsch ..... D03D 35/00 139/138
4,694,866 A * 9/1987 Kuo-Ching ..... D03D 37/00 139/458

(Continued)

FOREIGN PATENT DOCUMENTS

| | | |
|---|---|---|
| DE | 9103167.2 | 6/1991 |
| EP | 0580528 | 1/1994 |
| FR | 2868090 | 3/2004 |

OTHER PUBLICATIONS

Search Report from related French Application No. 1560370, dated Sep. 21, 2016.

*Primary Examiner* — Bobby Muromoto, Jr.
(74) *Attorney, Agent, or Firm* — Dowell & Dowell, PC

(57) ABSTRACT

A weaving machine (1) equipped with a level adjustment device (8) for a plurality of oscillating levers (26), the oscillating levers being provided with cam followers (42) and mounted on a shaft (28) of the levers, the shaft of the levers being movable between a weaving configuration, where the cam followers of the oscillating levers bear against cams (18) of the shedding mechanism, and a level adjustment configuration, where the cam followers of the oscillating levers are separated from the cams of the shedding mechanism. The level adjustment device comprises a level adjustment picking cam member secured to the shaft of the levers. The shedding mechanism further comprises a pad translatable along a fixed axis (X66) between a first position corresponding to the weaving configuration of the shaft (28) of the levers (26) and a second position corresponding to the level adjustment configuration of the shaft of the levers, and at least one level adjustment connecting rod (60) including a first end (84) mounted pivoting on the level adjustment picking cam member around an axis (X84) of the connecting rod parallel to the central axis (X28) of the shaft of the levers and a second end (86) mounted pivoting on the pad around an articulation axis (X86) of the pad parallel to the axis of the shaft of the levers.

17 Claims, 15 Drawing Sheets

(56) References Cited

U.S. PATENT DOCUMENTS

| | | | | |
|---|---|---|---|---|
| 4,766,935 | A * | 8/1988 | Tanaka | D03C 5/005<br>139/55.1 |
| 6,708,731 | B1 * | 3/2004 | Lamprillo | D03D 51/34<br>139/370.2 |

* cited by examiner

SHEDDING MECHANISM COMPRISING A LEVEL ADJUSTMENT DEVICE AND WEAVING MACHINE INCLUDING SAID MECHANISM

The present invention relates to a shedding mechanism for a weaving machine including a level adjustment device. Lastly, the invention relates to a weaving machine including such a shedding mechanism.

In the field of weaving machines, it is known to equip a weaving machine with a shedding mechanism such that frames of the machine are moved by oscillating levers of the shedding mechanism. These levers are mounted on a shaft and are provided with cam followers bearing against cams of the shedding mechanism. During weaving, the frames of the weaving machine and the levers of the shedding mechanism are in a so-called weaving configuration. Conversely, during certain maintenance or adjustment operations of the weaving machine, for example when a fault occurs in the weaving machine or a warp yarn breaks, it is necessary to bring all of the frames of the machine, and thus the levers of the mechanism, into a shared so-called level adjustment configuration.

In this respect, it is known, for example from FR-A-2,868,090, to equip the shedding mechanism with a level adjustment device configured to mechanically disengage the cam followers with the cams. The level adjustment device is a rod-rocker arm system: an electric motor is configured to actuate a threaded rod on which a nut is mounted secured to a maneuvering arm. The maneuvering arm makes it possible to exert a rotational torque on a picking cam connected to the shaft of the oscillating levers. Thus, the picking cam can tilt the shaft of the levers between the weaving configuration and the level adjustment configuration. However, using this approach, the motor oscillates within the frame between the weaving configuration and the level adjustment configuration. Furthermore, this approach causes sealing problems of the electric motor and certain difficulties in arranging the level adjustment device in the weaving machine.

In this respect, it is also known, for example from the EP-A-0,580,528, to use a level adjustment device equipped with a picking cam secured to the shaft of the levers and articulated between a moving rod of a jack and a bowed connecting rod. The jack and the bowed connecting rod are articulated on a frame of the shedding mechanism. The jack is configured to rotate the picking cam and move the shaft of the levers between the weaving configuration and the level adjustment configuration. However, such a level adjustment device requires a powerful actuator. The jack is highly stressed and must exert a substantial force in order to move the shaft of the levers. Furthermore, the operation of such a level adjustment device is accompanied by a jolt of the actuator, which is detrimental to the lifetime of the shedding mechanism. Lastly, such a level adjustment device also suffers from problems regarding the sizing of the parts, their resistance to forces and the lubrication.

The invention more particularly aims to resolve these drawbacks by proposing a new level adjustment device that makes it possible to use a low-power motor.

In this spirit, the invention relates to a shedding mechanism for a weaving machine equipped with a level adjustment device for a plurality of oscillating levers, the oscillating levers being provided with cam followers and mounted on a shaft of the levers, the shaft of the levers being movable between a weaving configuration, where the cam followers of the oscillating levers bear against cams of the shedding mechanism, and a level adjustment configuration, where the cam followers of the oscillating levers are separated from the cams of the shedding mechanism. The level adjustment device comprises a level adjustment picking cam member secured to the shaft of the levers. According to the invention, the shedding mechanism further comprises a pad translatable along a fixed axis between a first position corresponding to the weaving configuration of the shaft of the levers and a second position corresponding to the level adjustment configuration of the shaft of the levers, and at least one level adjustment connecting rod including a first end mounted pivoting on the level adjustment picking cam member around an axis of the connecting rod parallel to the central axis of the shaft of the levers and a second end mounted pivoting on the pad around an articulation axis of the pad parallel to the axis of the shaft of the levers.

Owing to the invention, the level adjustment device allows the use of a fixed electric motor positioned outside the frame. Furthermore, the transmission forces of the motor torque to the level adjustment lever are scaled down by the use of a connecting rod and greater than those of the previous solutions, which allows the use of a low-power electric motor such that power necessary for the level adjustment is cut in half relative to the current solutions. The level adjustment connecting rod has a significant lever arm that drives the shaft of the levers, while the pad makes it possible to react the forces from the level adjustment device in order to preserve the motor axle. The bulk of this level adjustment device is moderate. Furthermore, it is easily accessible to a maintenance operator.

According to advantageous, but optional aspects of the invention, such a shedding mechanism may comprise one or more of the following features, considered in any technically allowable combination:

- The translation axis of the pad is perpendicular to the articulation axis of the level adjustment connecting rod on the pad.
- In the weaving configuration:
  - an orthogonal projection, in a projection plane perpendicular to the central axis of the shaft of the levers, of a longitudinal axis of the level adjustment connecting rod that perpendicularly connects the axis of the level adjustment connecting rod and the articulation axis of the pad
  - an orthogonal projection, in the same projection plane, of an axis that perpendicularly connects the axis of the level adjustment connecting rod and the central axis of the shaft of the levers define a first angle, the value of which is comprised between 80° and 100°, preferably equal to 90°, to within 2°.

- In the weaving configuration:
  - an orthogonal projection, in a projection plane perpendicular to the axis of the shaft of the levers, of the translation axis of the pad, and
  - an orthogonal projection, in the same projection plane, of a longitudinal axis of the level adjustment connecting rod that perpendicularly connects the axis of the level adjustment connecting rod and the articulation axis of the pad, and define, in the movement plane, an angle of the picking cam member whereof the value is comprised between 90° and 110°, preferably equal to 95° to within 2°, this second angle being defined on the side of the travel of the pad when it is in the weaving configuration.

- The shaft of the levers is:
  - guided in translation at each of its ends by a guide slot defined in a platen, and translatable along an axis of each guide slot, between the weaving configuration and the level adjustment configuration.

The shedding mechanism further comprises:

a side arm secured to the shaft of the levers and rotatable around the central axis of the shaft of the levers between a first position corresponding to the weaving configuration of the shaft of the levers and a second angular position corresponding to the level adjustment configuration of the shaft of the levers, and at least one connecting rod mounted pivoting on the level adjustment picking cam member at one end of the arm around an axis of the arm and mounted pivoting on a frame of the shedding mechanism around an axis of the frame and movable between a third position corresponding to the weaving configuration of the shaft of the levers and a fourth position corresponding to the level adjustment configuration of the shaft of the levers.

When the connecting rod is in the third position, the center distance between the axis of the arm and the axis of the frame is equal to a first value, and when the connecting rod is in the fourth position, this center distance is equal to a second value, the first value being greater than the second value.

The level adjustment picking cam member is secured to a connecting member rotatable around a fixed axis, the central axis of the shaft of the levers is parallel to and does not coincide with the rotation axis of the level adjustment picking cam member, and the shaft of the levers is rotatable around the rotation axis of the level adjustment picking cam member between the weaving configuration and the level adjustment configuration.

The level adjustment picking cam member is comprises [sic] an arm rotatable around the fixed axis, the arm extending parallel to the central axis of the shaft of the levers and securing the shaft of the levers in rotation with the level adjustment picking cam member eccentrically relative to the fixed axis.

The level adjustment picking cam member is a level adjustment lever that comprises at least one arm mounted pivoting on the axis of the level adjustment connecting rod and a central portion secured in rotation with the shaft of the levers.

The pad is a tapped nut that is mounted on a threaded rod rotatable around the axis of the pad.

The threaded rod is rotated around the axis of the pad by an electric motor fixed on a frame of the shedding mechanism.

The pad is submerged in a lubricating oil bath of a frame of the shedding mechanism.

Lastly, the invention relates to a weaving machine including a shedding mechanism as described above.

The invention and other advantages thereof will appear more clearly, in light of the following description of several embodiments of a shedding mechanism according to its principle, provided solely as an example and done in reference to the drawings, in which.

Figure 1:
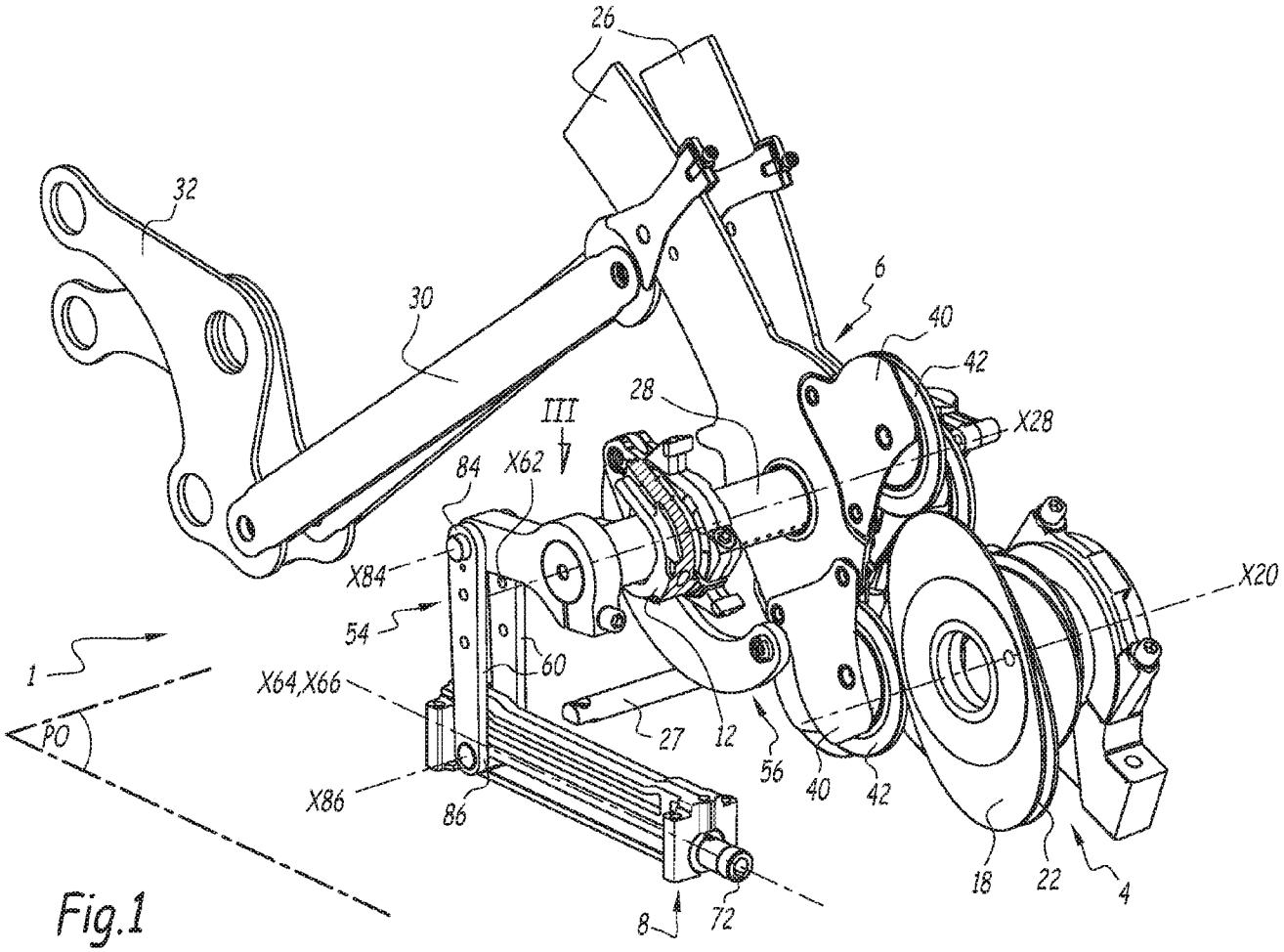
FIG. 1 is a perspective view of a shedding mechanism according to a first embodiment, certain components of which have been omitted for the clarity of the drawing and when a shaft of the levers is in a weaving configuration.

A weaving machine, which is not shown in the figures, comprises several heald frames. The different frames of the machine are driven by a vertical oscillating movement, imparted using a shedding mechanism 1. The weaving machine thus includes two operating phases: a first so-called weaving phase, and a second so-called level adjustment phase.

In the weaving phase, the shedding mechanism 1 imparts the oscillating movement to the frames. The weaving machine is thus in the process of weaving. In the level adjustment phase, the weaving machine stops weaving and the frames are all arranged in a neutral position where a warp sheet is in a single plane.

The shedding mechanism 1, of the cam mechanism type, includes a frame 2, a set 4 of cams, a system 6 of levers, a level adjustment device 8, a motor 10 and two platens 12.

The frame 2 is configured to contain the components of the shedding mechanism 1 and defines a bearing plane P0 in which the components are arranged. The frame 2 includes a base 14 and a cover 16. A quantity of lubricating oil is received in the base 14, such that the components of the shedding mechanism 1 are submerged in a lubricating oil bath.

The cover 16 of the frame 2 is configured to close the shedding mechanism 1 and thus performs a protective function for the components of the shedding mechanism 1.

The set of cams 4 includes a plurality of cams 18, a shaft 20 of the cams and an actuator, which is not shown in figures. Each cam 18 includes an outer track 22 and is mounted on the shaft 20. Reference X20 denotes a longitudinal axis of the shaft 20. This axis represents the shaft 20 in FIGS. 1 and 2. The shaft 20 is rotatable around its axis X20 and is driven by the actuator of the cam machine 4. Thus, the cams 18 are also rotatable around the axis X20 of the shaft 20.

The shaft 20 is supported by the platens 12 that are fixed to the frame 2. In particular, each platen 12 includes a bearing 24 in which the shaft 20 is arranged.

The system of levers 6 includes a plurality of oscillating levers 26, a stop 27 and a shaft 28 of the levers.

The levers 26 are provided in a number equivalent to the number of heald frames of the weaving machine. For example, the number of levers 26 is equal to eight or ten, preferably equal to ten.

Each lever 26 is hitched to one of the aforementioned frames, using a connecting rod 30 and a bent lever 32 and a set of pull rods, not shown. Alternatively, cables connect the levers 26 to the corresponding heald frame.

Each lever 26 includes an elongate portion 34 and a central portion 36. The elongate portion 34 is configured to transmit the vertical oscillating movement to the aforementioned connecting rod 30. The central portion 36 is equipped with an orifice 38 and two flanges 40. Between each flange 40 and the central portion 36, a cam follower 42 is mounted in a yoke. Thus, each lever 26 includes two cam followers 42 that are able to bear against the tracks 22 of the cams 18.

The levers 26 are mounted on the shaft 28, which defines a central axis X28 that is parallel to the axis X20. Thus, the shaft 28 of the levers is movable, around the central axis X28, between a first so-called weaving configuration and a second so-called level adjustment configuration.

The weaving configuration of the shaft 28 corresponds to the weaving phase of the weaving machine. In particular in the weaving configuration, the cam followers 42 of the levers 26 bear against the tracks 22 of the cams 18.

Conversely, the level adjustment configuration corresponds to the level adjustment phase of the weaving machine. In particular, the cam followers 42 of the levers 26 are separated from the tracks 22 of the cams 18. Occasionally, one of the two cam followers 42 of a lever may remain in contact with a track 22 depending on the arrangement of the cam 18 relative to its axis X20 opposite it. The level adjustment configuration guarantees an alignment of the frames at a same height despite these occasional contacts.

The stop 27 of the levers 26 has a semi-cylindrical shape. It is arranged parallel to the axes X20 and X28. The stop 27 is supported by the platens 12 and is arranged at a certain height relative to the base 14 of the frame 2. The stop 27 is configured to stop the tilting of the levers 26 driven by the weight of the rotating frames toward the level adjustment configuration. The shaft 28 is also supported by the platens 12 fixed to the frame 2. In particular, each platen 12 defines a guide slot 44 of the shaft 28. Each guide slot 44 is globally in the shape of an inclined C relative to the bearing plane P0 of the frame 2. For example, the slots 44 are centered on an axis X44 that is inclined relative to the plane P0 by about 40°. Each guide slot 44 thus includes a bottom 440 able to receive the shaft 28 by bearing in the weaving configuration.

Thus, the shaft 28 of the levers 26 is furthermore translatable along the axis X44 of each slot 44, between the weaving configuration and the level adjustment configuration.

The shaft 28 has a cylindrical and circular section in a plane P1 perpendicular to the plane P0 of the frame 2. Reference d28 denotes the outer diameter of the shaft 28 measured parallel to the plane P1. Reference 45 also denotes two surfaces of the shaft 28 that define the ends of the shaft 28.

The shaft 28 of the levers 26 is divided into several portions. Reference 46 denotes a first guide portion, 48 denotes a support portion of the levers, 50 denotes a second guide portion and 52 denotes an articulation portion. The first and second guide portions 46 and 50 are configured to be arranged each in a guide slot 44. The portion 48 represents the shaft portion 28 where the levers 26 are mounted. The articulation portion 52 is secured to the level adjustment device 8 of the shedding mechanism 1.

The portions 46, 48, 50 and 52 of the shaft 28 are separated by circlips 53.

According to one alternative that is not shown in the figures, the portions of the shaft 28 are separated by shoulders having a diameter along the plane P1 greater than the diameter d28 of the shaft 28.

The level adjustment device 8 is configured to actuate the shaft 28 of the levers 26 and move it between the weaving configuration and the level adjustment configuration, in rotation around the axis X28 and in translation along the slots 44.

The motor 10 is a low-power asynchronous electric motor, for example below 500 W. The motor 10 is arranged on the same side of the shaft 28 as the level adjustment device 8. The arrangement of the motor 10 is not limiting: the motor 10 can be positioned, for example, opposite the level adjustment device 8 relative to the shaft 28.

Figure 2:
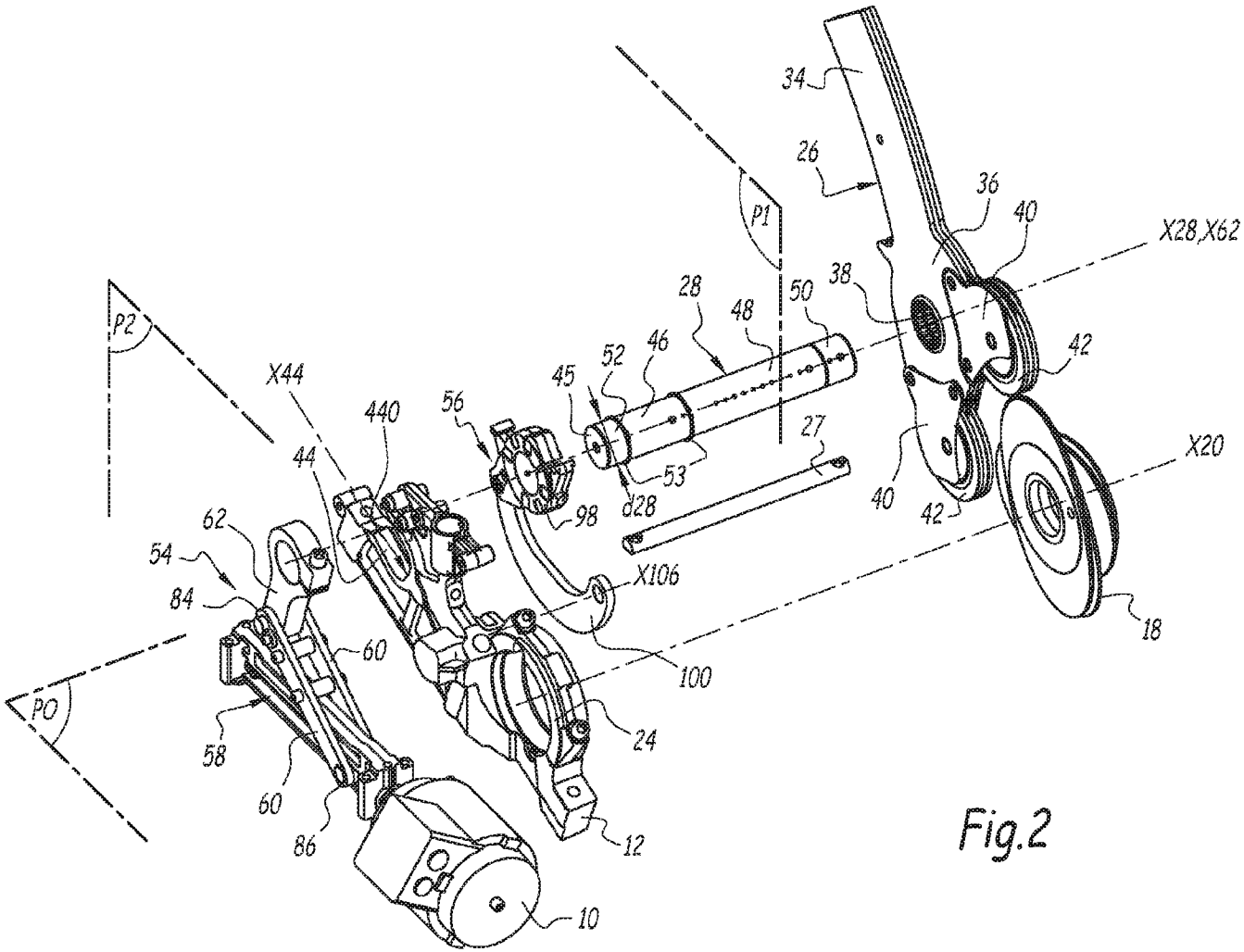
FIG. 2 is an exploded view of the shedding mechanism of FIG. 1, certain components of which have been omitted and when the shaft of the levers is in a level adjustment configuration.
Figure 3:
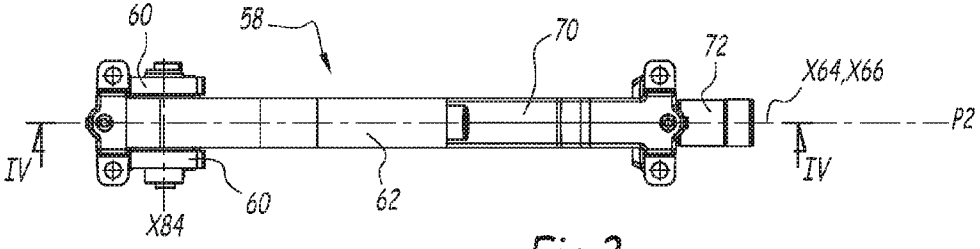
FIG. 3 is a view, along arrow III in FIG. 1, of an articulated level adjustment member of the level adjustment device.
Figure 4:
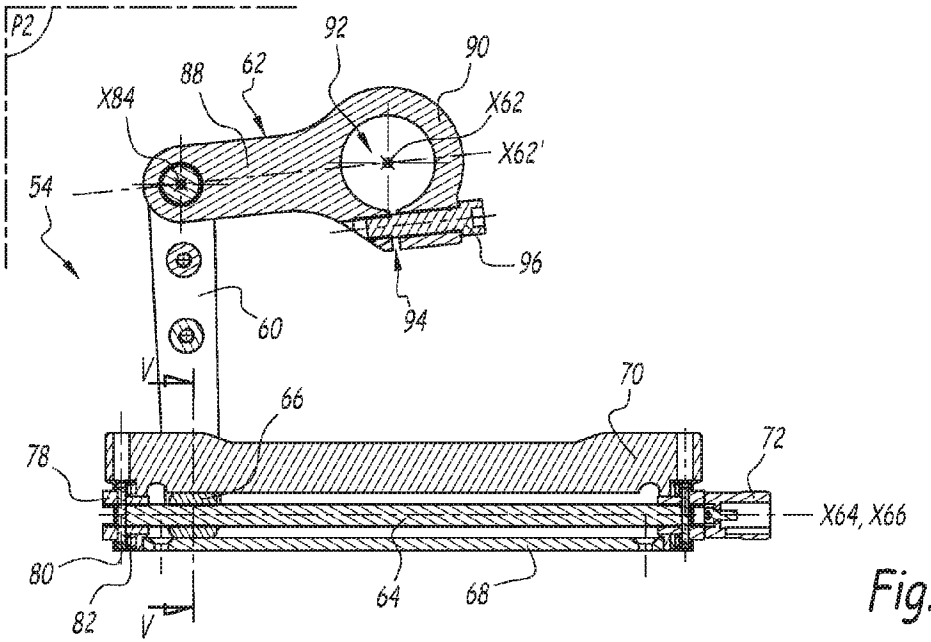
FIG. 4 is a sectional view, in plane IV-IV of FIG. 3, of the articulated level adjustment member.
Figure 5:
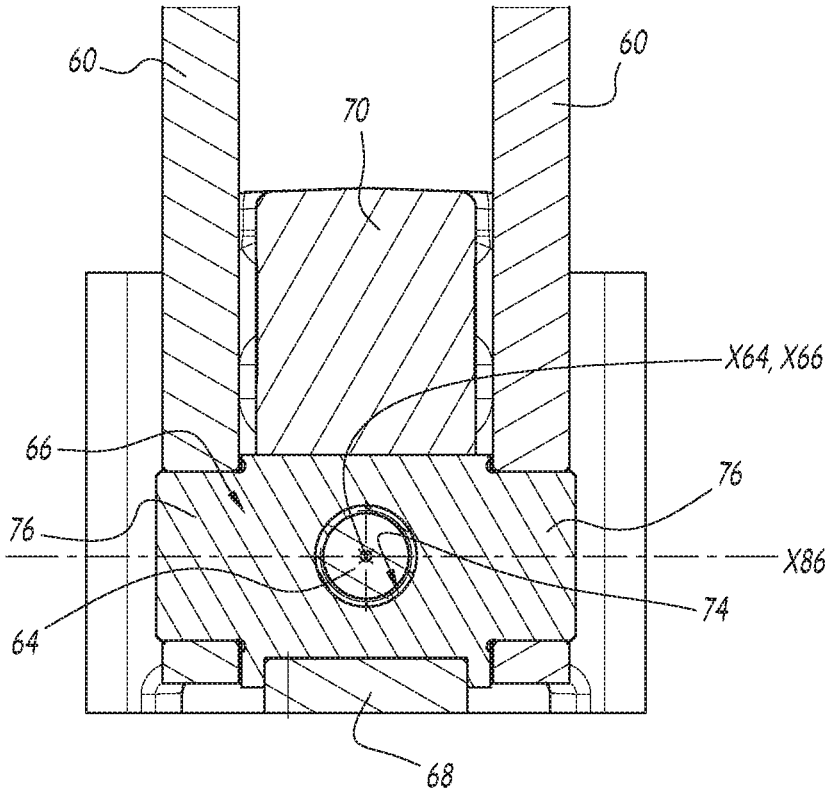
FIG. 5 is a partial sectional view, in plane V-V of FIG. 4, of the articulated level adjustment member.

The level adjustment device 8 includes an articulated level adjustment member 54 and a locking mechanism 56. As shown in FIG. 1, the member 54 and the mechanism 56 are arranged on the same side of the system 6 of the levers 26. In particular, the member 54 and the mechanism 56 are arranged on either side of the adjacent platen 12.

The position of the level adjustment device 8 is not limiting. Alternatively, the level adjustment device 8 is arranged opposite the set of cams 4 relative to the shaft 28 or in another position along the axis X28.

The articulated level adjustment member 54 comprises a transmission system 58, two level adjustment connecting rods 60 and a level adjustment picking cam member 62.

The transmission system 58 is, in the example illustrated in the figures, a screw-nut system. In particular, the system 58 includes a threaded rod 64, a pad 66, a lower guide 68 and an upper guide 70.

The threaded rod 64 is positioned parallel to the plane P0 of the frame 2 and defines a longitudinal axis X64 that is parallel to this plane P0. The threaded rod 64 is secured to a rotating shaft of the motor 10 using an end-piece 72. Thus, the threaded rod 64 is rotatable around its axis X64.

The pad 66 of the transmission system 58 is a tapped nut mounted on the threaded rod 64. The pad 66 thus includes a tapping 74 able to receive the threaded rod 64 and two lateral bosses 76 configured to secure the level adjusting rods 60 to the pads 66.

Reference X66 denotes an axis of the pad 66 that traverses the threaded tapping 74. When the pad 66 is mounted on the threaded rod 64, the axes X64 and X66 coincide and are stationary relative to the frame 2. A rotation of the threaded rod 64 thus causes the pad 66 to move along its axis X66. Thus, the pad 66 is translatable along its axis X66 between a first so-called weaving position shown in FIG. 6, which corresponds to the weaving configuration of the shaft 28 of the levers 26, and a second so-called level adjustment position shown in FIG. 8, which corresponds to the level adjustment configuration of the shaft 28.

The pad 66 is made from cast iron. Alternatively, the pad 66 is made from steel or bronze.

The threaded rod 64 is supported by two bearings 78 that are fixed to the rod 64 using pins 80. Furthermore, needle bearings 82 are provided bearing on the upper guide 70 in order to react axial forces generated by the threaded rod 64.

The lower 68 and upper 70 guides are configured to guide the pad 66 in its movement along the axis X66 and to react radial forces generated by the rod 64. The guides 68 and 70 are rails that form planar supports for the pad 66. They form linear paths secured to the frame 2. The lower guide 68 is a steel graduated beam. The lower 68 and upper 70 guides define contact surfaces made from pretreated steel. Indeed, during the movement of the pad 66, a good quality of the surfaces of the guides 68 and 70 makes it possible to optimize the sliding and span of the pad 66 under a load.

The threaded rod 64 and the pad 66 are submerged in the lubricating oil bath of the frame 2 such that the contact of the pad on the rod by sliding is done in the presence of oil between the weaving and level adjustment configurations.

The connecting rods 60 are configured to transmit a movement force from the pad 66 to the level adjustment picking cam member 62. In practice, the level adjustment connecting rods 60 are able to provide a torque C to the level adjustment picking cam member 62. Each level adjustment connecting rod 60 includes a first end 84 articulated to the level adjustment picking cam member 62 and a second end 86 articulated on a corresponding boss 76 of the pad 66. In practice, the level adjustment connecting rods 60 are mounted in a yoke on the lateral bosses 76 of the pad 66. The level adjustment connecting rods 60 are assembled using a plurality of screws and spacers. Thus, the level adjustment connecting rods 60 form a single rigid level adjustment member. Each connecting rod 60 extends essentially along an axis X60 that connects the ends 84 and 86 of this connecting rod 60.

Reference X84 denotes the articulation axis around which the first end 84 of a level adjustment connecting rod 60 is articulated on the level adjustment picking cam member 62. Reference X86 also denotes an articulation axis around which the second end 86 is articulated on the pad 66. The axes X84 and X86 are parallel to one another and perpendicular to the axis X66 of the pad 66. Thus, the axes X84 and X86 are also parallel to the axes X20 of the shaft 20 and X28 of the shaft 28. Each axis X60 connects the axes X84 and X86 to one another.

The level adjustment picking cam member 62 is movable between two different positions respectively corresponding to the level adjustment and weaving configurations of the shaft 28. Reference P2 denotes a movement plane of the level adjustment picking cam member 62. The plane P2 is the geometric plane that is parallel to the plane P1 and that contains the center of gravity of the level adjustment picking cam member 62 in its two different positions mentioned above.

Here, the level adjustment picking cam member 62 moves in the plane P2, i.e., its center of gravity is contained in the plane P2 all throughout its movement between its two different positions.

Reference X62 denotes a longitudinal axis of the level adjustment picking cam member 62 that is perpendicular to the plane P2 and that passes through the geometric center of a connecting zone of the level adjustment picking cam member 62 with the shaft of the levers 28.

Reference X62' denotes a lateral axis of the level adjustment picking cam member 62, which connects the axis X84 of the level adjustment picking cam member and the axis X28 of the shaft of the levers perpendicularly. In the embodiment illustrated in FIGS. 1 to 9, the lever arm 88 extends essentially along the axis X62' and the axis X62' belongs to the plane P2.

The level adjustment picking cam member 62 is articulated on the first ends 84 of the level adjustment connecting rods 60, as described above. It is secured to the lever 26 shaft 28. In particular, the level adjustment picking cam member 62 is a level adjustment lever that includes a lever arm 88 and a central portion 90. The level arm 88 is engaged in a yoke between the first ends 84 of the level adjustment connecting rods 60. The central portion 90 includes a central bore 92 that is centered on the axis X62. More specifically, the axis X62 is perpendicular to the section of the central bore 92 and passes through the center of the section, here circular, of this central bore 92. This section here forms the connecting zone. In the assembled configuration of the level adjustment device 8, the axis X62 coincides with the axis X28 of the shaft 28 of the levers 26. Thus, the axis X62 of the level adjustment picking cam member 62 is parallel to the axis X20 of the shaft 20 of the cams 18 and also to the articulation axes X84 and X86 of the level adjustment connecting rods 60.

The central portion 90 includes a slit 94 and a screw 96. The slit 94 is configured to adapt the bore 92 to the diameter d28 of the shaft 28 of the levers 26. The screw 96 is able to tighten the slit 94, so as to block the shaft 28 of the levers 26 in the bore 92.

Thus, the level adjustment picking cam member 62 is rotatable, with the shaft 28 of the levers 26, around its central axis X62, which coincides with the axis X28 of the shaft 28, and translatable along the slots 44 of the platens 12.

In practice, the level adjustment picking cam member 62 is movable, as described above, in the movement plane P2. This plane P2 corresponds to the plane of FIGS. 4, 6, 8, 12 and 13. A median plane of the rigid level adjustment member 60, equivalent to the plane of symmetry of inner surfaces of the connecting rods 60 that make up this member, coincides with the movement plane P2. The assembly formed by the level adjustment connecting rods 60 and the level adjustment picking cam member 62 moves in the plane P2. The movement plane P2 is perpendicular to the bearing plane P0 and parallel to the plane P1. Thus, the translation axis X66 of the pad 66 is arranged in the movement plane P2, while the axes X20, X28, X62, X84 and X86 are perpendicular to the movement plane P2. Furthermore, the movement plane P2 is comprised between the two end surfaces 45 of the shaft 28. The axis X60 is parallel to the movement plane P2.

The level adjustment connecting rods 60 and the level adjustment picking cam member 62 are thus configured to generate a torque C on the shaft 28. The torque C is necessary in order to rotate the shaft 28 around its axis X28 from one configuration to the other.

The locking mechanism 56 of the level adjustment device 8 is configured to lock the shaft 28 and the level adjustment device 8 in the weaving and level adjustment configurations. The locking mechanism 56 includes a side arm 98 and a connecting rod 100.

The side arm 98 is secured to the shaft 28 of the levers 26. Thus, the side arm 98 is rotatable, with the shaft 28, around the central axis X28 of the shaft 28 between a first so-called angular position, shown in FIG. 6, which corresponds to the weaving configuration of the shaft 28, and a second so-called angular position, shown in FIG. 8, which corresponds to the level adjustment configuration of the shaft 28. The side arm 98 includes a central portion 102 and an extension 104. The central portion 102 is secured around the shaft 28 of the levers 26, while the extension 104 extends radially to the axis X28 of the shaft 28 and is configured to be articulated on the connecting rod 100 at an axis X104.

The connecting rod 100 is configured to transmit a locking force to the side arm 98 and thus to the shaft 28. The connecting rod 100 is articulated between the extension 104 of the side arm 98 and a fixed point 106 of the platen 12 of the frame 2. Reference X106 denotes the axis around which the connecting rod is articulated on the platen 12. The connecting rod 100 is made from steel and crescent-shaped between the pivot axes X104 and X106. Thus, the connecting rod 100 is movable around the axis X106 in the plane P1 between a third so-called weaving position shown in FIG. 6, which corresponds to the weaving configuration of the shaft 28 of the levers 26, and a fourth so-called level adjustment position shown in FIG. 8, which corresponds to the level adjustment configuration of the shaft 28. The weaving configuration of the shaft 28 stresses the connecting rod 100 elastically in its third position. Reference e100 denotes the center distance measured between the axes X104 and X106 in the plane P1. When the connecting rod 100 is in its third position, the center distance e100 is equal to a first value. When the connecting rod 100 is in its fourth position, the center distance e100 is equal to a second value. The first value of the center distance e100 is greater than the second value. The center distance e100 may for example be 201 mm in the third position and 199 mm in the fourth position. Due to this difference in values of the center distance e100, when it is in its third position, the connecting rod 100 is tensed and constitutes elastic return means for the level adjustment device able to keep the arm 98 in its first angular position, in other words, able to keep the shaft in its weaving position.

According to an alternative that is not shown in the figures, the level adjustment device 8 includes two identical locking mechanisms 56 arranged on either side of the system 6 of the levers 26.

Lastly, the shedding mechanism 1 includes a plurality of sensors 107 for the position of the shaft 28. The position sensors 107 are of the contactless type and able to detect the end of travel in the weaving configuration and in the level adjustment configuration of the shaft 28 so as to command the movement of the motor and the side arm 98 between two positions.

Figure 6:
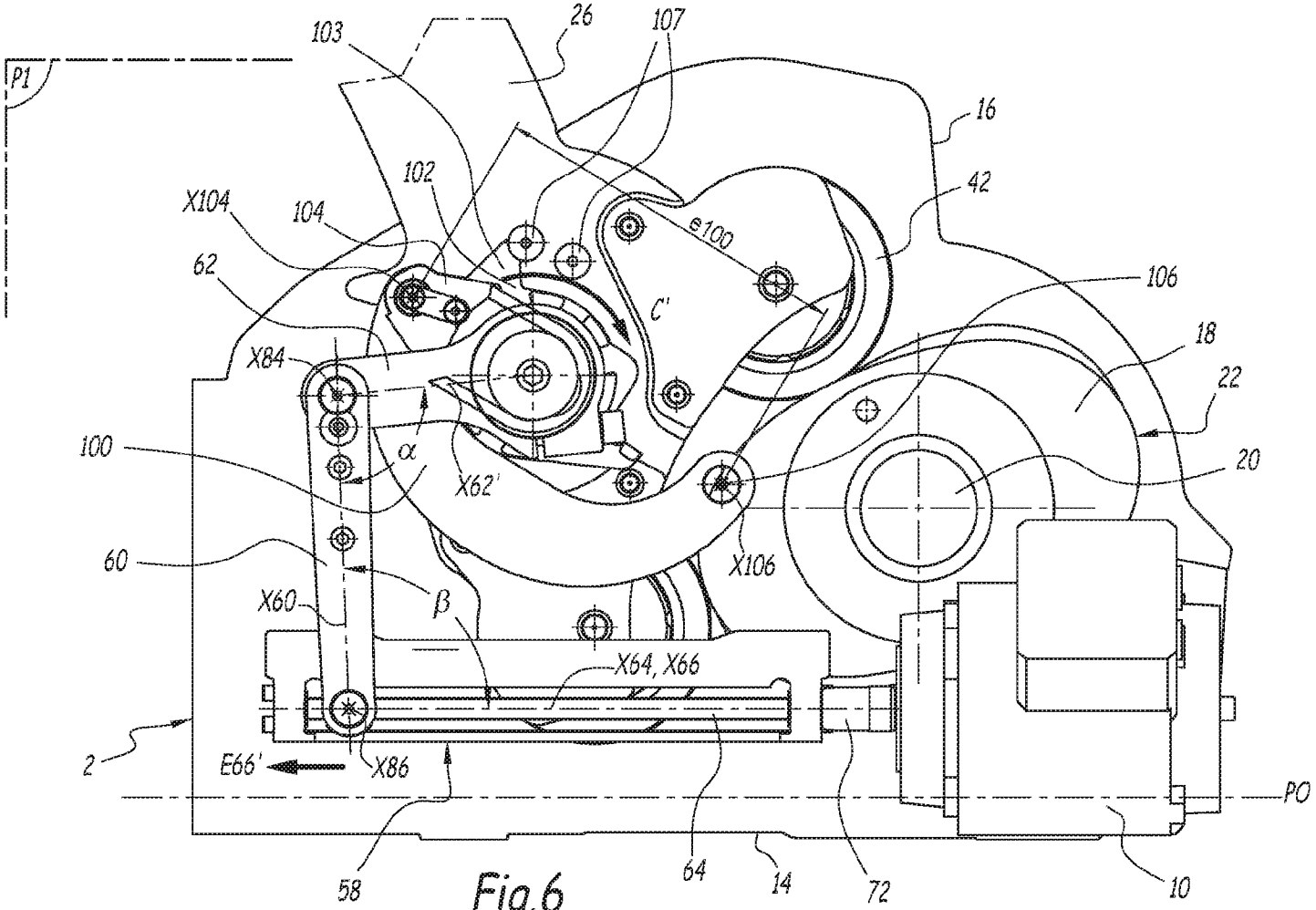
FIG. 6 is a side view of the shedding mechanism of FIG. 1.
Figure 7:
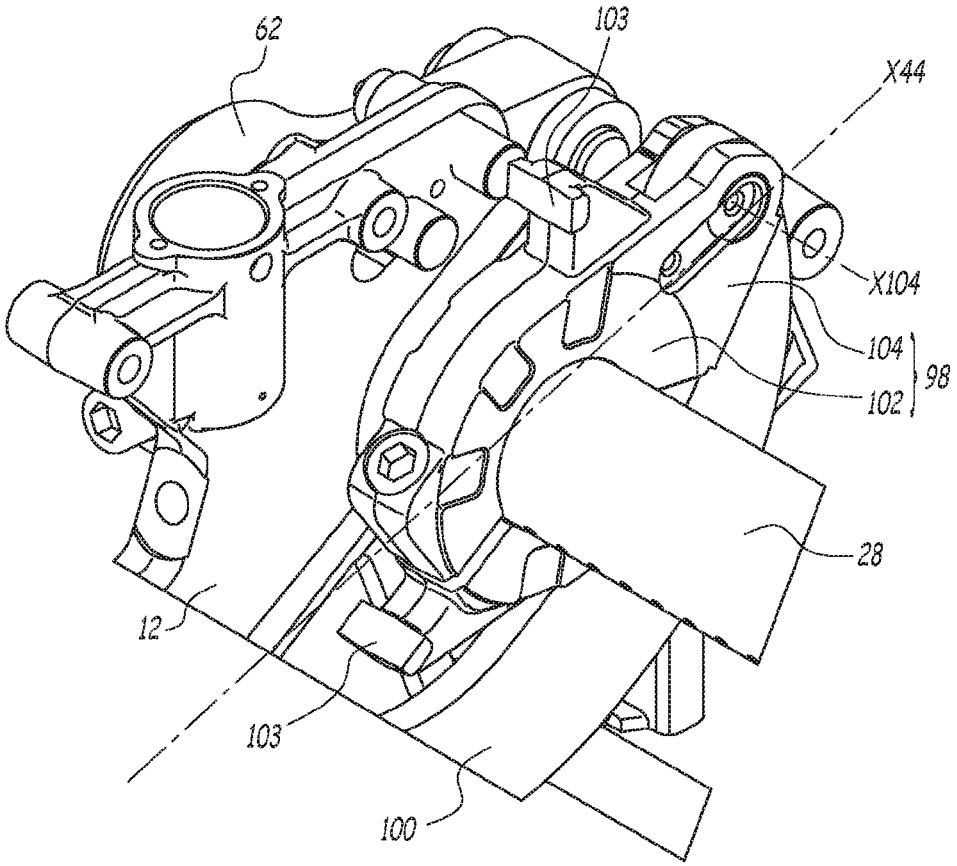
FIG. 7 is a partial perspective view, along arrow VII in FIG. 1, of the level adjustment device.

The operation of the shedding mechanism 1 is described below:

When the weaving machine is in the weaving phase, the shaft 28 of the levers 26 is in its weaving configuration. In particular, the pad 66 is in its first position. Thus, as shown in FIGS. 1 and 6, the level adjustment connecting rods 60 are perpendicular to the plane P0 of the frame 2. The orthogonal projections of the axes X60 and X62', in a projection plane perpendicular to the axis X28 of the shaft of the levers, define an angle $\alpha$ in this projection plane. This angle $\alpha$ is defined between these projections, on the side of the travel of the pad 66 when it is in the weaving configuration. The value of the angle $\alpha$ is comprised between 80° and 100°, preferably equal to 90°, to within 2°. The projection plane here is combined with the movement plane P2 previously defined.

The orthogonal projections of the axes X60 and X66 in a projection plane perpendicular to the axis X28 of the shaft of the levers define an angle $\beta$ in this projection plane. This angle $\beta$ is defined between these projections, on the side of the travel of the pad 66 when it is in the weaving configuration. The value of the angle $\beta$ is comprised between 90° and 110°, preferably close to 95°, i.e., equal to 95° to within 2°. This projection plane here is combined with the movement plane P2. Advantageously, the angle $\beta$ close to 95° makes it possible to situate an axis X64 of the rod 64 near the horizontal and a level adjustment connecting rod 60 close to the vertical in the weaving configuration, which opposes the unlocking movement of the shaft of the levers 28.

Furthermore, the side arm 98 is in its first angular position, while the connecting rod 100 is in its third position. Thus, the shaft 28 is bearing on the bottom 440 of the slots 44 and locked by the locking mechanism 56. The cam followers 42 of the levers 26 are in contact with the tracks 22 of the cams 18 of the cam machine 4. Thus, the rotation of the shaft 20 around the axis X20 generates the oscillating movements of the levers 26 that are transmitted, via the connecting rods 30 and the levers 32, to the frames of the weaving machine.

In order for the weaving machine to be able to enter the level adjustment phase, the level adjustment device 8 is actuated. The motor 10 is powered on and rotates the threaded rod 64 around the axis X64. This rotation generates the movement of the pad 66 from its first position to its second position. The pad generates a force E66 along its translation axis X66.

Figure 8:
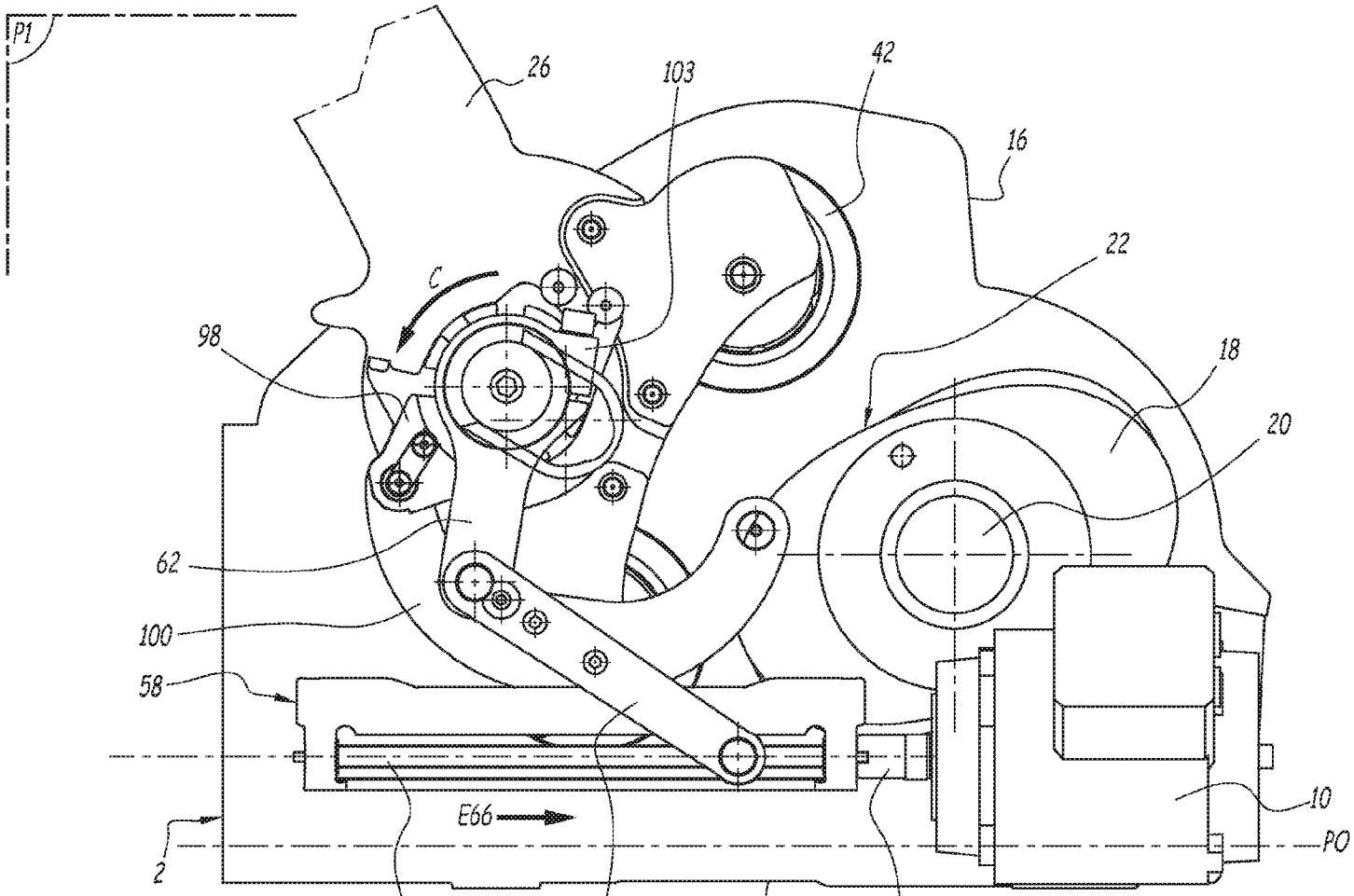
FIG. 8 is a view similar to FIG. 6, when the shaft of the levers is in the level adjustment configuration.
Figure 9:
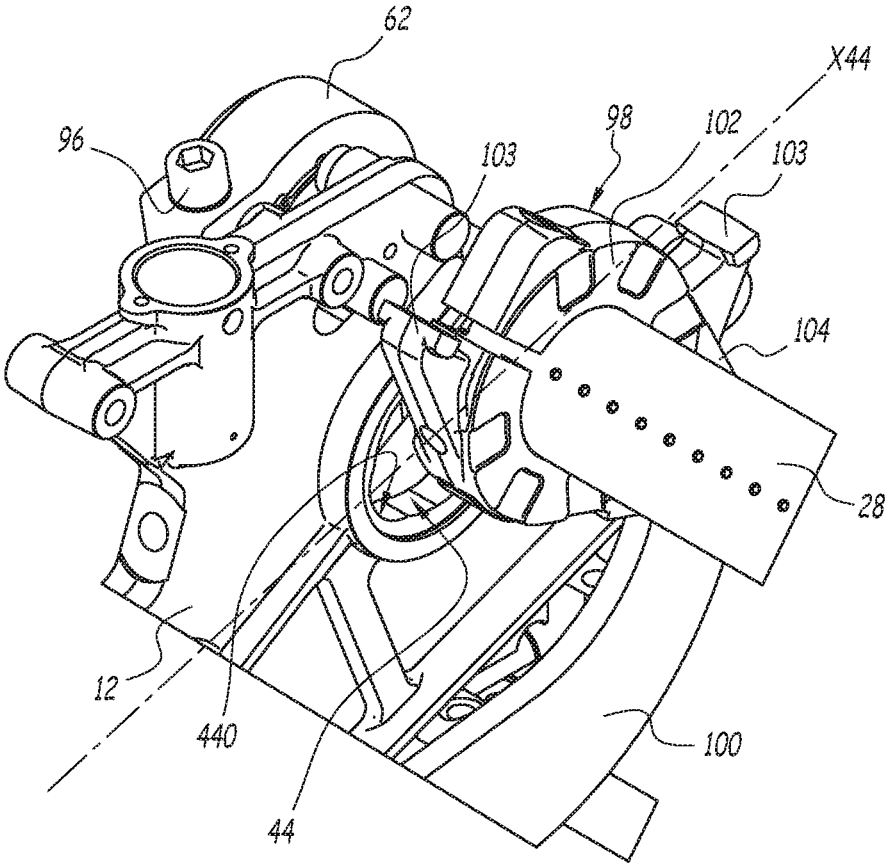
FIG. 9 is a view similar to FIG. 7, when the shaft of the levers is in the level adjustment configuration.
Figure 10:
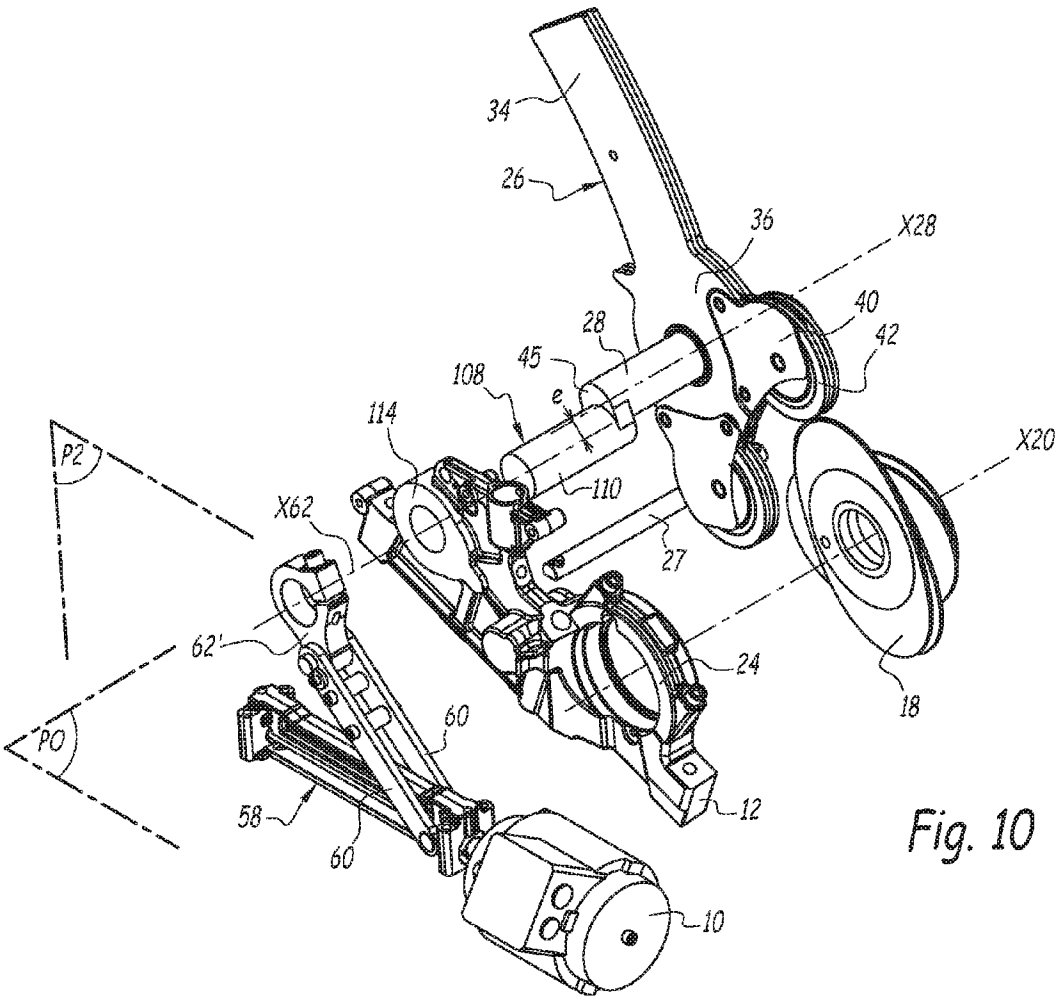
FIG. 10 is an exploded view of a shedding mechanism according to a second embodiment, certain components of which have been omitted.
Figure 11:
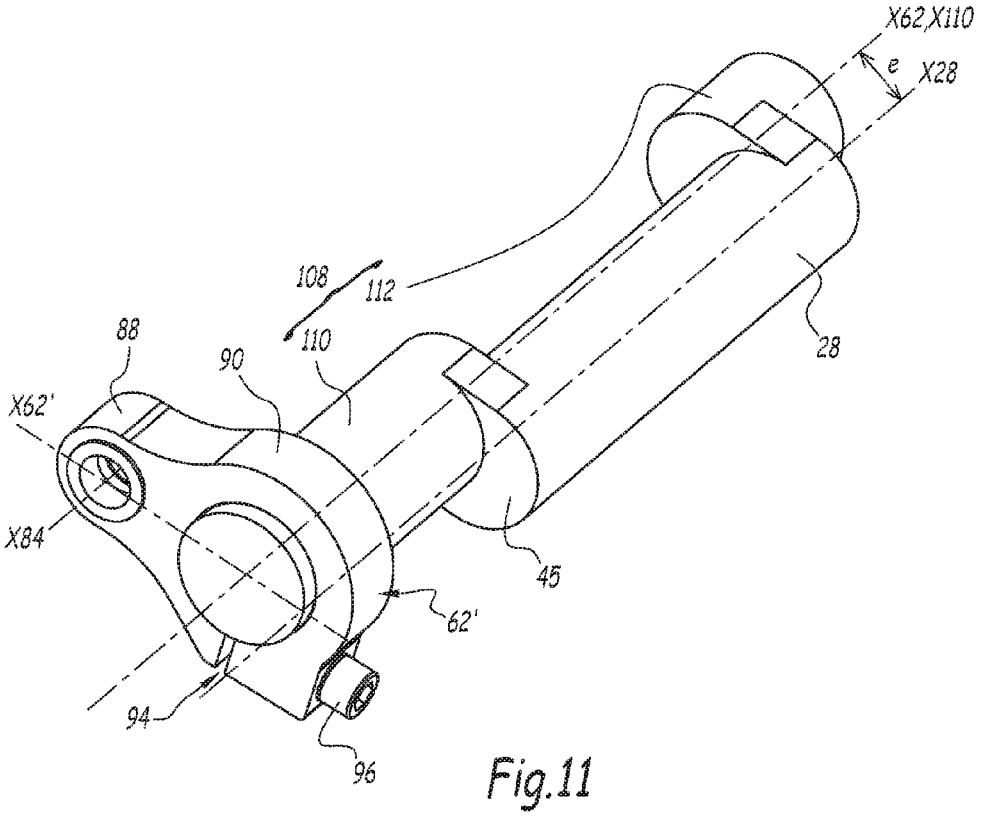
FIG. 11 is a perspective view of a level adjustment lever and the shaft of the levers of the shedding mechanism of FIG. 10.
Figure 12:
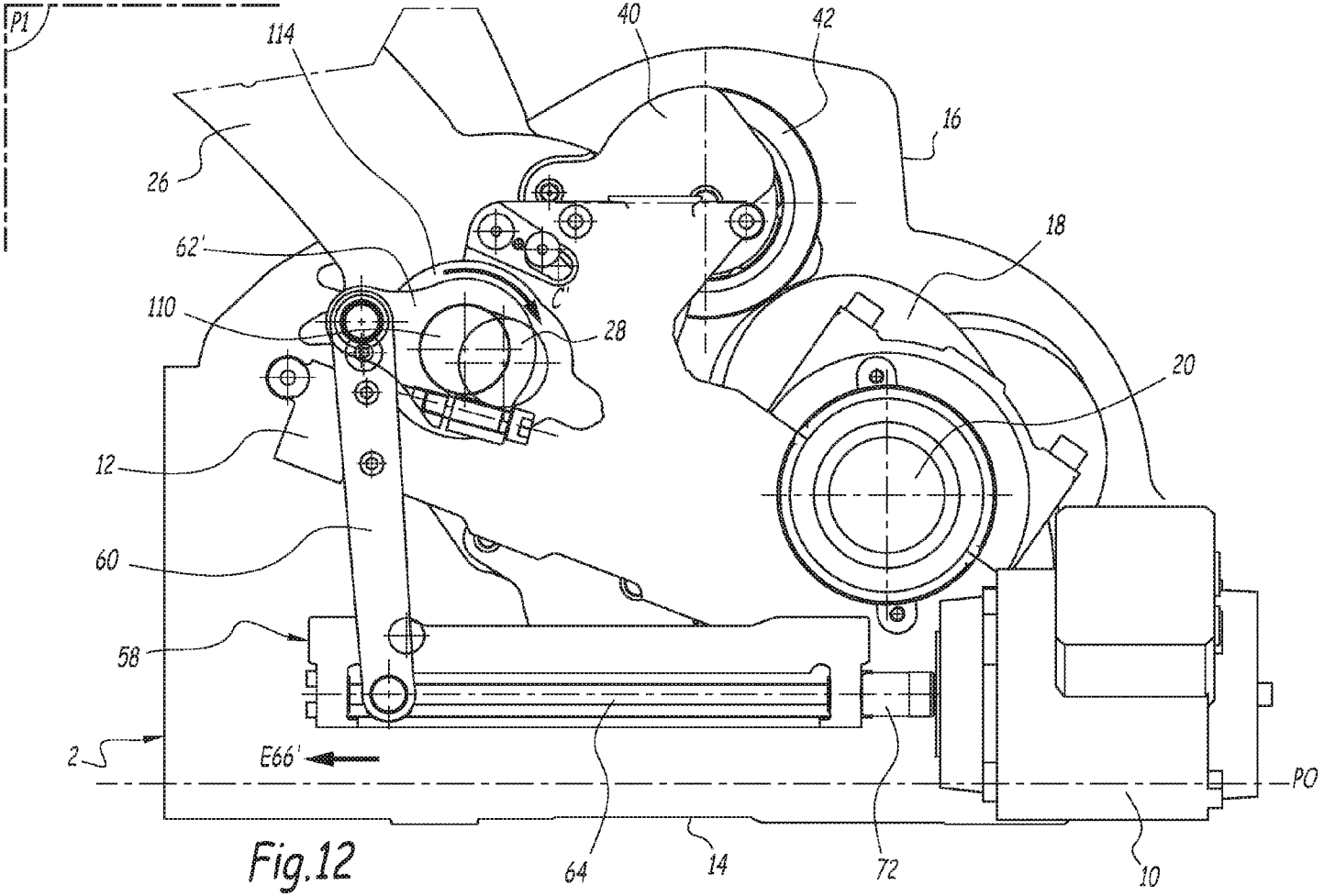
FIG. 12 is a side view of the shedding mechanism of FIG. 10, when the articulated level adjustment member is in the weaving configuration.
Figure 13:
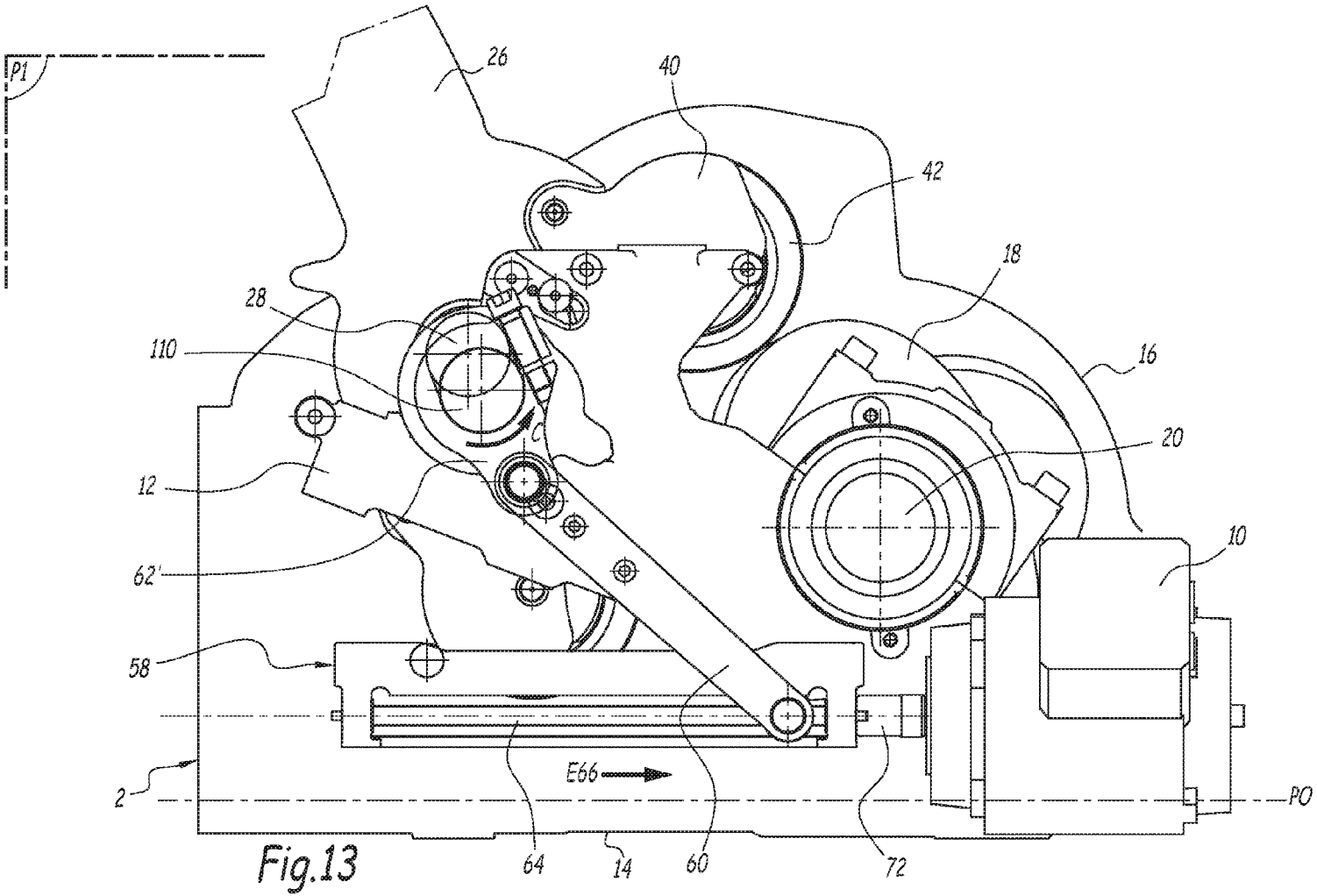
FIG. 13 is a view similar to FIG. 12, when the articulated level adjustment member is in the level adjustment configuration.

The force E66 generated by the pad 66 causes the movement of the level adjustment connecting rods 60 and level adjustment picking cam member 62. Thus, the level adjustment connecting rods 60 and the level adjustment picking cam member 62 are driven by the pad 66, as shown in FIG. 8. In particular, the level adjustment lever 62 rotates, around the axis X62, by an angle comprised between 45° and 100°, preferably equal to 75°.

As described above, the level adjustment picking cam member 62 transmits the torque C to the shaft 28. The shaft 28 rotates around its axis X28 and leaves the bottom 440 of the slots 44 to separate therefrom.

The rotation of the shaft 28 also creates the rotation of the side arm 98 of the locking mechanism 56, toward its second angular position, and the movement of the connecting rod 100, toward its fourth position.

Furthermore, due to the rotation of the shaft 28, the cam followers 42 are separated from the cams 18. The levers 26 bear against the stop 27 and the weaving machine is in the level adjustment configuration.

Next, to go from the level adjustment configuration to the weaving configuration of the weaving machine, the motor 10 drives the threaded rod 64 in a reverse rotation direction that makes it possible to move the pad 66 from its second position toward its first position. The pad 66 generates a force E66' with an intensity equal to and opposing the force E66. The force E66' is transmitted to the connecting rods 60 and the level adjustment picking cam member 62, which, similarly, generate a torque C' with an intensity equal to and opposing the torque C. The shaft 28 is set in rotation around its axis X28 and again reaches the weaving configuration. Thus, the shaft 28 bears on the bottom 440 of the slots 44, the cam followers 42 again being in contact with the cams 18 of the cam machine 4. The force E66 and the torque C cannot be constant throughout the entire movement of the pad 66 between its second and first positions, due to the geometry of the articulations of the level adjustment.

FIGS. 10 to 13 show a second embodiment of the invention. The elements of the shedding mechanism 1 of the second embodiment similar to those of the first embodiment bear the same references and are not described in detail inasmuch as the above description may be transposed to them.

The level adjustment device 8 of this second embodiment includes an articulated member 54 and a connecting member 108. The device is not provided with the locking mechanism 56.

The level adjustment picking cam member 62 here bears reference 62'. The member 62' is identical here to the member 62 and differs therefrom only inasmuch as its axis X62 is separate from the central axis X28 of the shaft 28.

The connecting member 108 includes a first arm 110 and a second arm 112. The arms 110 and 112 have a cylindrical section and have a diameter substantially equal to the diameter d28 of the shaft 28. The arms 110 and 112 are arranged on either side of the shaft 28. In particular, the arms 110 and 112 are respectively fixed on one of the ends 45 of the shaft 28. The arm 110 is arranged in the bore 92 of the level adjustment picking cam member 62'. The arm 110 defines an axis X110 that coincides with the axis X62 of the level adjustment picking cam member 62'. The axis 110 is stationary relative to the frame of the mechanism. Thus, the level adjustment picking cam member is secured, indirectly, to the shaft 28, owing to the arm 110.

The shaft 28 remains secured to the level adjustment picking cam member 62' while being mounted between the arms 110 and 112 of the connecting member 108 eccentrically relative to the level adjustment picking cam member 62'. Indeed, the central axis X28 of the shaft 28 is parallel to and does not coincide with the central axis X62 of the level adjustment picking cam member 62'. Reference e denotes the center distance between the axes X28 and X62.

The platens 12 are not provided with guide slots 44. On the contrary, the platens 12 each include a bearing 114 in which the shaft 28 is arranged along the axis X110.

The shaft 28 is set in rotation around the axis X62 of the level adjustment picking cam member 62' between the weaving configuration and the level adjustment configuration. Indeed, the center distance e between the axes X28 and X62 allows the lever 26 shaft 28 to travel, during its movement, over a sufficient arc of circle to separate the axis X28 of the shaft 28 from the axis X20 of the shaft 20 and to thus cause the cams 18 to lose contact with the cam followers 42.

According to an alternative of this second embodiment of the invention that is not shown, the shaft 28 is mounted on the connecting member 108 using rolling means such as smooth bearings, roller bearings or another rotating guide means arranged in the connecting member, such that the shaft 28 can rotate around its axis X28 and around the axis X62 of the level adjustment picking cam member 62'.

Figure 14:
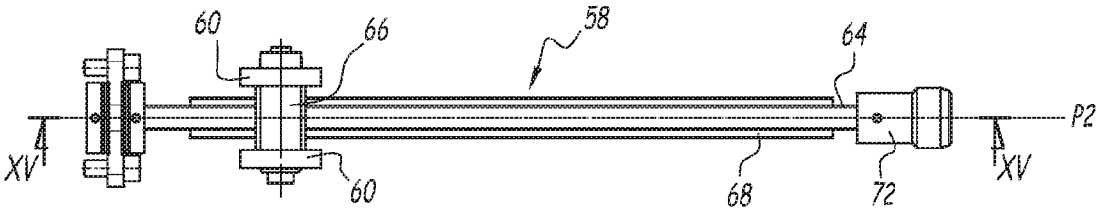
FIG. 14 is a view similar to FIG. 3 of an alternative of the articulated level adjustment member.
Figure 15:
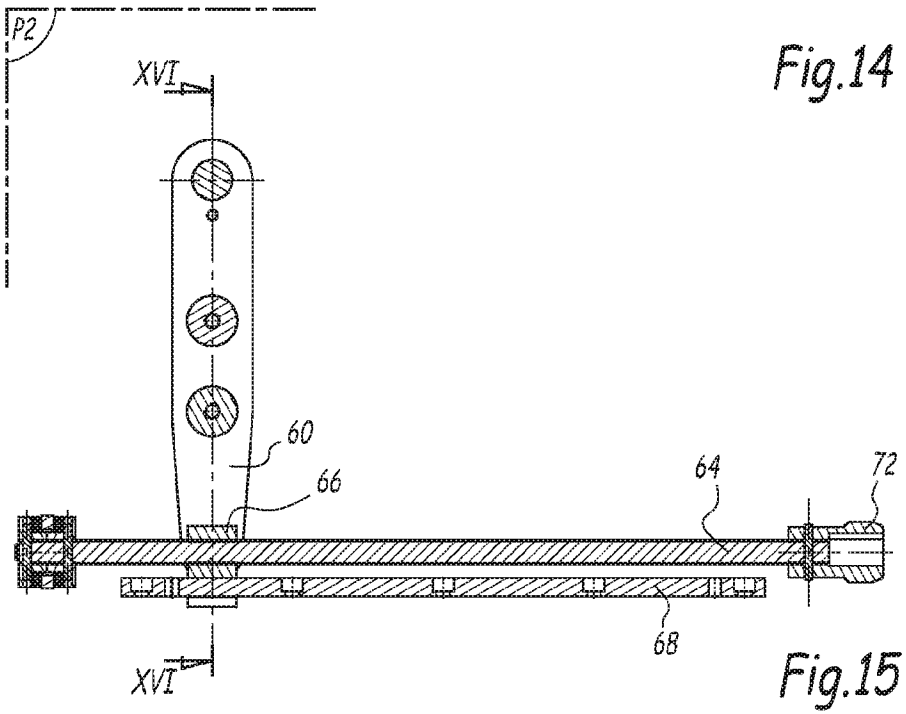
FIG. 15 is a sectional view, in plane XV-XV of FIG. 14, of the articulated level adjustment member.
Figure 16:
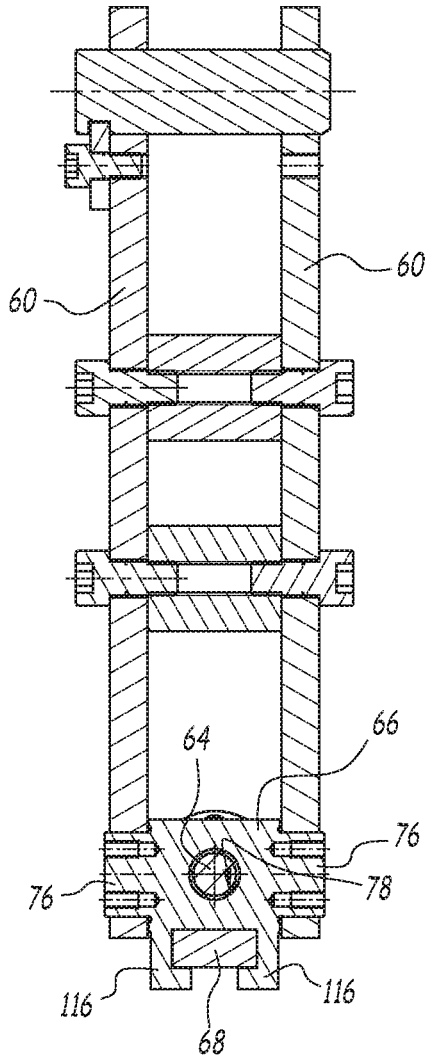
FIG. 16 is a sectional view, in plane XVI-XVI of FIG. 14, of the articulated level adjustment member.

According to one alternative of the articulated level adjustment member 54 of the level adjustment device 8, which is shown in FIGS. 14 to 16 and which is compatible with both of the embodiments of the invention described above, the transmission system 58 of the level adjustment device 8 includes a single lower guide 68. The pad 66 is equipped with two side prongs 116 configured to engage the lower guide 68 in a yoke, so as to maintain contact between the pad 66 and the lower guide 68. The lower guide 68 has an I- or T-shaped profile and is fixed to the base 14 of the frame 2.

According to another alternative that is not shown in the figures, the guides 68 and 70 include rolling bearings, such as steel wheels, engaged between the two guides 68 and 70.

According to still another alternative that is not shown, the articulated level adjustment member 54 includes a single level adjustment connecting rod 60 that is for example cantilevered or engaged in a yoke between two lugs of the level adjustment picking cam member 62 when the latter is a level adjustment lever.

According to another alternative that is not shown, the considered locking mechanism may vary in that the side arm 98 is omitted. The connecting rod 100 is then directly attached on the assembly formed by the level adjustment connecting rod 60 and the level adjustment picking cam member 62'.

Figures 17, 18:
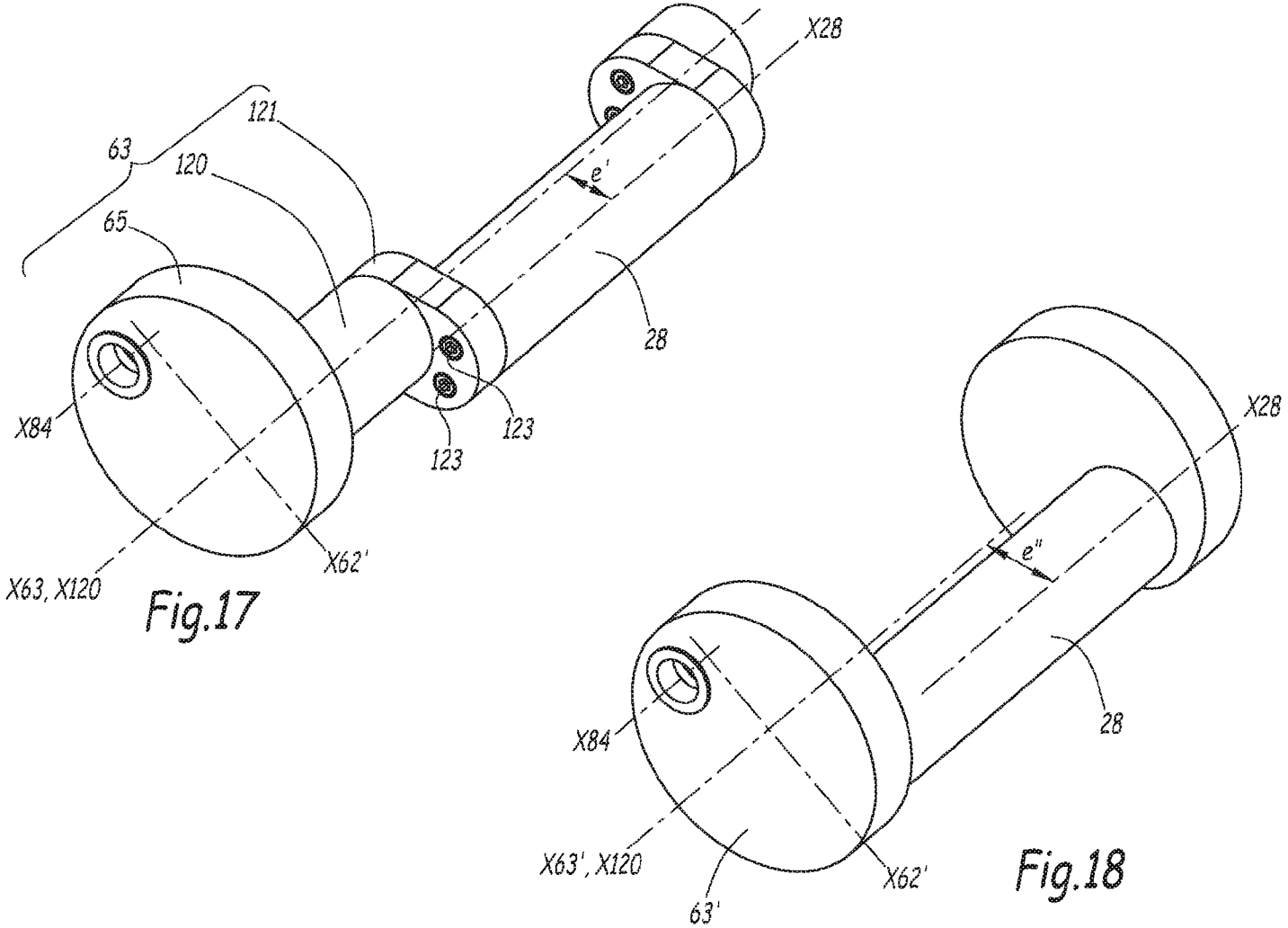
FIGS. 17 and 18 are perspective views of level adjustment members of the shaft of levers belonging to shedding mechanisms according to other embodiments.

According to another alternative shown in FIG. 17, the level adjustment picking cam member 62' is replaced by a level adjustment picking cam member 63 that performs the same function. The level adjustment picking cam member 63 includes a disc 65 for example with a circular or elliptical base, that includes a circular bore centered on the articulation axis X84 around which the level adjustment connecting rod 60 is mounted pivoting. An arm 120 is secured to the disc 65 and extends along a longitudinal axis X120. The axis X120 is stationary relative to the frame 2 of the mechanism 1. Reference X63 denotes a longitudinal axis of the level adjustment picking cam member 63. The axes X63 and X120 coincide. The axis X63 has the same function with respect to the level adjustment picking cam member 63 as the axis X62 with respect to the level adjustment picking cam member 62 mentioned above. The connecting zone previously described here corresponds to the portion of the face of the disc 65 that is in direct contact with the arm 120.

A connecting member 121 connects the arm 120 to the shaft of the levers 28, such that the arm 120 and the shaft 28 are parallel to one another with a lateral shift e' between the axes X28 and X120. The lateral shift e' is measured perpendicular to the axes X28 and X120. This connecting member 121 is fixed with no degree of freedom at one end of the shaft 28 by fastening means such as assembly screws 123 received in the connecting member 121. The connecting member 121 is also fixed with no degree of freedom at one end of the arm 120, for example using screws identical to the screws 123. Thus, the level adjustment picking cam member 63 is secured to the shaft 28, owing to the arm 120 and the connecting member 121. Here, the arm 120 and the connecting member 121 are part of the level adjustment picking cam member 63. The disc 65 and the arm 120 advantageously represent a single-piece assembly rotatable in the frame 2, around the axis X120. The connecting member 121 could also form a single piece with the arm 120 and the disc 65. In other words, the assembly of the disc 65, the arm 120 and the connecting member 121 forms a rocker arm articulated with the level adjustment connecting rod 60 around the axis X84 and with the lever 26 around the axis X28.

Alternatively, the level adjustment picking cam member 63 does not include the arm 120 and the connecting member 121.

According to another alternative shown in FIG. 18, the shaft of the levers 28 is directly fixed to a level adjustment picking cam member 63', which replaces the level adjustment picking cam member 62. The level adjustment picking cam member 63' is for example a cylindrical picking cam with a circular base, here identical to the disc 65. On its other end, the shaft of the levers 28 is fixed to another picking cam member 67, for example identical to the level adjustment picking cam member 63'. This here for example involves the shared shaft known from FR-A-2,868,090. The shaft of the levers 28 is then supported relative to the frame 2 using two picking cam members 63' and 67 via bearings mounted in the frame 2. The level adjustment picking cam member 63' is rotatable around a rotation axis X63' perpendicular to the plane P2 and that passes through the center of the level adjustment picking cam member 63'. The axis X63' has the same function with respect to the level adjustment picking cam member 63' as the axis X62 with respect to the level adjustment picking cam member 62' mentioned above. This axis X63' is parallel to the axis X28 and is arranged eccentrically relative to this axis X63'. The axis X63' is stationary relative to the frame 2. Reference e" denotes the center distance between the axes X63' and X28. The shaft of the levers 28 is rotatable around the axis X63' between the level adjustment and weaving configurations. The level adjustment picking cam member 63' here has a circular shape to ensure rotation within the span of the frame 2.

Irrespective of the embodiment, the articulated member 54 is arranged such that the level adjustment connecting rod(s) 60 is or are perpendicular to the plane P0 of the frame 2 in the weaving phase. Thus, the level adjustment connecting rod(s) 60 and the level adjustment picking cam member 62, 63 or 63' define the angle $\alpha$ of 90° between them when the lever shaft 28 is in the weaving configuration.

The embodiments and alternatives considered above can be combined to provide new embodiments of the invention.

The invention claimed is:

1. A shedding mechanism for a weaving machine equipped with a level adjustment device for a plurality of oscillating levers, the oscillating levers being provided with cam followers and mounted on a shaft of the levers, the shaft of the levers being movable between:

a weaving configuration, where the cam followers of the oscillating levers bear against cams of the shedding mechanism, and a level adjustment configuration, where the cam followers of the oscillating levers are separated from the cams of the shedding mechanism, the level adjustment device comprising a level adjustment picking cam member secured to the shaft of the levers, and wherein the shedding mechanism further comprises:

a pad translatable along a fixed axis between a first position corresponding to the weaving configuration of the shaft of the levers and a second position corresponding to the level adjustment configuration of the shaft of the levers, and at least one level adjustment connecting rod including a first end mounted pivoting on the level adjustment picking cam member around an axis of the connecting rod parallel to the central axis of the shaft of the levers and a second end mounted pivoting on the pad around an articulation axis of the pad parallel to the axis of the shaft of the levers.

2. The shedding mechanism according to claim 1, wherein the translation axis of the pad is perpendicular to the articulation axis of the level adjustment connecting rod on the pad.

3. The shedding mechanism according to claim 2, wherein, in the weaving configuration, an orthogonal projection, in a projection plane perpendicular to the central axis of the shaft of the levers, of a longitudinal axis of the level adjustment connecting rod that perpendicularly connects the axis of the level adjustment connecting rod and the articulation axis of the pad, and an orthogonal projection, in the same projection plane, of an axis that perpendicularly connects the axis of the level adjustment connecting rod and the central axis of the shaft of the levers, define a first angle, the value of which is comprised between 80° and 100°.

4. The shedding mechanism according to claim 3, wherein the value of the first angle is equal to 90°, to within 2°.

5. The shedding mechanism according to claim 2, wherein, in the weaving configuration, an orthogonal projection, in a projection plane perpendicular to the axis of the shaft of the levers, of the translation axis of the pad, and an orthogonal projection, in the same projection plane, of a longitudinal axis of the level adjustment connecting rod that perpendicularly connects the axis of the level adjustment connecting rod and the articulation axis of the pad define, in the movement plane, a second angle of the picking cam member whereof the value is comprised between 90° and 110°, this second angle being defined on the side of the travel of the pad when it is in the weaving configuration.

6. The shedding mechanism according to claim 5, wherein the value of the second angle is equal to 95° to within 2°.

7. The shedding mechanism according to claim 1, wherein the shaft of the levers is:

guided in translation at each of its ends by a guide slot defined in a platen, and translatable along an axis of each guide slot, between the weaving configuration and the level adjustment configuration.

8. The shedding mechanism according to claim 7, wherein it further comprises:

a side arm secured to the shaft of the levers and rotatable around the central axis of the shaft of the levers between a first angular position corresponding to the weaving configuration of the shaft of the levers and a second angular position corresponding to the level adjustment configuration of the shaft of the levers, and at least one connecting rod mounted pivoting on the level adjustment picking cam member at one end of the arm around an axis of the arm and mounted pivoting on a frame of the shedding mechanism around an axis of the frame and movable between a third position corresponding to the weaving configuration of the shaft of the levers and a fourth position corresponding to the level adjustment configuration of the shaft of the levers.

9. The shedding mechanism according to claim 8, wherein when the connecting rod is in the third position, the center distance between the axis of the arm and the axis of the frame is equal to a first value, and when the connecting rod is in the fourth position, this center distance is equal to a second value, the first value being greater than the second value.

10. The shedding mechanism according to claim 1, wherein:

the level adjustment picking cam member is rotatable around a fixed axis, the central axis of the shaft of the levers is parallel to and does not coincide with the rotation axis of the level adjustment picking cam member, and the shaft of the levers is rotatable around the rotation axis of the level adjustment picking cam member between the weaving configuration and the level adjustment configuration.

11. The mechanism according to claim 10, wherein the level adjustment picking cam member comprises an arm rotatable around the fixed axis, the arm extending parallel to the central axis of the shaft of the levers and securing the shaft of the levers in rotation with the level adjustment picking cam member eccentrically relative to the fixed axis.

12. The mechanism according to claim 10, wherein the level adjustment picking cam member is directly fixed eccentrically to the shaft of the levers.

13. The shedding mechanism according to claim 1, wherein the level adjustment picking cam member is a level adjustment lever that comprises at least one arm mounted pivoting on the axis of the level adjustment connecting rod and a central portion secured in rotation with the shaft of the levers.

14. The shedding mechanism according to claim 1, wherein the pad is a tapped nut that is mounted on a threaded rod rotatable around the axis of the pad.

15. The shedding mechanism according to claim 14, wherein threaded rod is rotated around the axis of the pad by an electric motor fixed on a frame of the shedding mechanism.

16. The shedding mechanism according to claim 1, wherein the pad is submerged in a lubricating oil bath of a frame of the shedding mechanism.

17. A weaving machine including a shedding mechanism, wherein the shedding mechanism is according to claim 1.

* * * * *